US006095926A

United States Patent [19]

Hettema et al.

[11] Patent Number: 6,095,926

[45] Date of Patent: Aug. 1, 2000

[54] AMUSEMENT RIDE VEHICLE

[75] Inventors: Philip D. Hettema, Los Angeles, Calif.; William D. Mason, Orlando, Fla.; Gary Goddard, North Hollywood, Calif.

[73] Assignee: Universal Studios, Inc., Universal City, Calif.

[21] Appl. No.: 09/070,950

[22] Filed: May 1, 1998

(Under 37 CFR 1.47)

[51] Int. Cl.[7] ..... A63G 31/02

[52] U.S. Cl. ..... 472/59; 472/43; 434/55; 104/85

[58] Field of Search ..... 472/59, 60, 61, 472/130, 43; 434/55; 104/53, 83, 85, 154

[56] References Cited

U.S. PATENT DOCUMENTS

| | | | |
|---|---|---|---|
| 717,457 | 12/1902 | Schofield . | |
| 771,322 | 10/1904 | Pattee et al. . | |
| 814,939 | 3/1906 | Cerruti . | |
| 815,211 | 3/1906 | Pattee et al. . | |
| 852,184 | 4/1907 | Hunt . | |
| 858,624 | 7/1907 | Reckweg . | |
| 921,416 | 5/1909 | Lauster . | |
| 1,397,009 | 11/1921 | Maynes . | |
| 2,535,862 | 12/1950 | Pewitt . | |
| 3,669,026 | 6/1972 | Mouritzen . | |
| 4,170,943 | 10/1979 | Achrekar . | |
| 4,303,236 | 12/1981 | Czarnecki | 472/60 |
| 4,642,945 | 2/1987 | Browning et al. . | |
| 4,856,771 | 8/1989 | Nelson et al. . | |
| 5,060,932 | 10/1991 | Yamaguchi . | |
| 5,453,053 | 9/1995 | Danta et al. . | |
| 5,473,990 | 12/1995 | Anderson et al. | 104/85 |
| 5,556,340 | 9/1996 | Bohn et al. . | |
| 5,558,582 | 9/1996 | Swensen et al. . | |
| 5,669,821 | 9/1997 | Prather et al. | 472/59 |

*Primary Examiner*—Kien T. Nguyen
*Attorney, Agent, or Firm*—Lyon & Lyon LLP

[57] ABSTRACT

An amusement ride vehicle includes a vehicle chassis that rolls on caster wheels. Pinch drive wheels, driven by on-board electric motors, engage a guide rail and propel the vehicle along a rack. A motion base is positioned on top of the vehicle chassis. A yaw ring is rotatably supported on the motion base. A passenger cabin is mounted on to the yaw ring. A slip ring assembly extends from the vehicle chassis to the passenger cabin, to provide electrical power and audio signals to the passenger cabin. A yaw drive motor turns the yaw ring, allowing the passenger cabin to spin on the motion base, and to provide continuous yaw movement. The motion base provides pitch and roll movements, as well as heave, slip and surge movements.

22 Claims, 7 Drawing Sheets

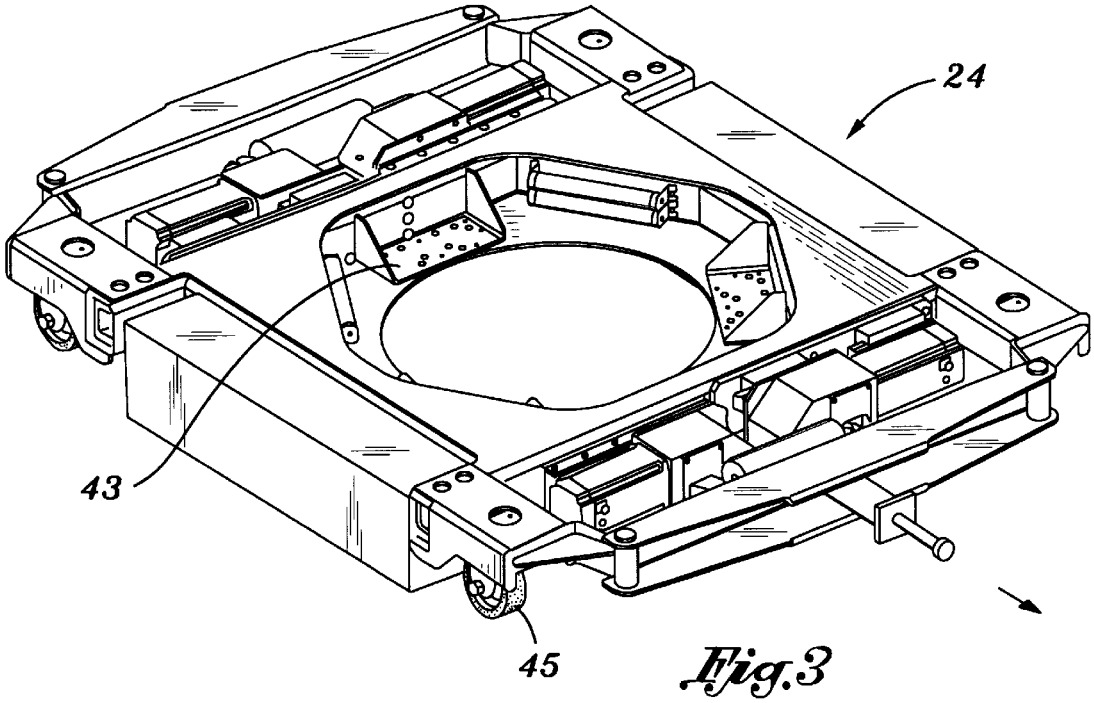
Fig. 3
Fig. 4
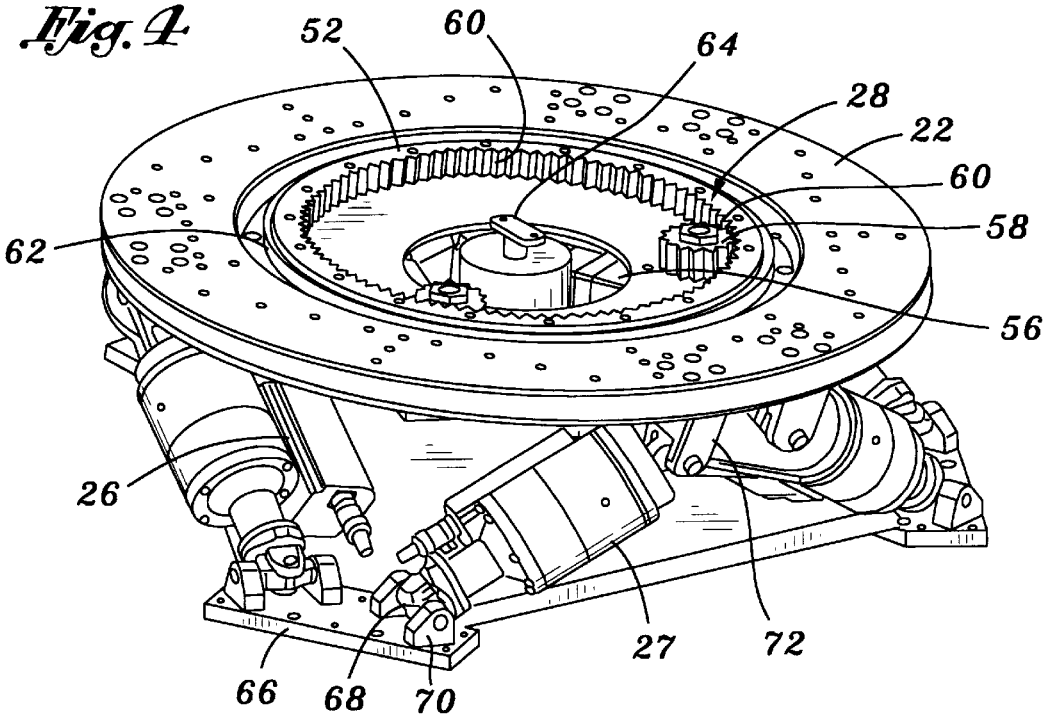

AMUSEMENT RIDE VEHICLE

FIELD OF THE INVENTION

This invention is in the field of amusement/theme park attractions. More particularly, the invention relates to an amusement ride vehicle that moves along a track and allows for a passenger cabin to be moved or rotated in any direction to face fixed or projected environments along the track.

BACKGROUND OF THE INVENTION

Various amusement rides have been created to provide passengers with unique motion and visual experiences, including roller coasters, theme rides, and simulators. Roller coasters and theme rides typically have the limitation of being a fixed ride experience, with changes to the ride being made only at great expense. As a result, passengers can become familiar with the ride, which limits the excitement of the ride. Additionally, roller coasters and theme rides generally lack the ability to be pointed and rotated in any direction. While simulators can easily create varying scenery and movement with programming changes, as well as moving a passenger in almost any direction, simulators fall short in their ability to create an actual ride experience. The passenger in a simulator does not receive the experience of actually traveling. Rather, the passenger remains fixed and the visual and sensory experience is generally created at a fixed location.

To create improved rides, simulators have been placed on moving vehicles. The vehicle typically travels over a set course with the motion base providing e.g., controlled pitch, roll, heave, surge, and slip movement, as well as limited yaw movement. However, conventional simulators, whether fixed or vehicle mounted, generally have limited yaw control and movement. Simulators with a six-axis motion base, for example, can provide for only limited yaw movement. Consequently, these types of rides are often not able to be rotated to face the passengers in any direction, without actually rotating the entire vehicle with respect to its intended path of motion along a track.

Some roller coasters and related rides having 360 degree or continuous yaw movement have been proposed. However, in combination with this yaw rotation, these types of rides typically do not allow for pitch, heave, surge, and slip of the passenger compartment. Thus, these rides cannot orient passengers in a large number of directions.

Accordingly, there is a need for an improved amusement ride vehicle.

SUMMARY OF THE INVENTION

To these ends, the present invention provides an amusement ride vehicle that moves along a track and allows for a passenger cabin to be rotated or pointed to any position.

In a preferred embodiment, an amusement ride vehicle moves through environments created by fixed and dynamic scenery as well as visual effects on projection screens located throughout the ride. The screens can provide the normal 2-D display, but in a preferred embodiment, the projection screens provide for 3-D display. The passenger cabin moves in coordination with visual effects provided on the screens, or the fixed and dynamic scenery encountered during the course of the ride. Sound effects and lighting, as well as other special effects, can also be provided to the passenger cabin to further enhance the ride experience.

The vehicle advantageously includes a motion base connected to a chassis. The motion base provides, for example, six degrees of freedom using actuators. The vehicle chassis preferably is guided by a track and provides forward and reverse motion, as well as accelerating and decelerating the vehicle. Preferably, the track has curvatures that cause the vehicle to move from side to side. A yaw drive system on the chassis turns the passenger cabin up to 360 degrees, in clockwise or counter-clockwise (bi-directional) rotation with very fine accuracy. The six degrees of freedom provided by the motion base combined with the 360 degree yaw movement allows for placement of sets, screens, special effects, and other features to be placed in almost any location throughout the course of the ride. Advantageously, the passenger cabin is rotated or pointed to control the sight lines of the passengers, preventing them from seeing certain areas of the ride or directing their sight to a specific area. The invention also permits a spinning sensation to be added to the ride, heightening passenger ride experience.

BRIEF DESCRIPTION OF THE DRAWINGS

FIG. 3 is an isometric view of the chassis of the vehicle shown in FIG. 2;

FIG. 4 is a isometric view of the present yaw drive system and motion base;

DETAILED DESCRIPTION

Figure 1:
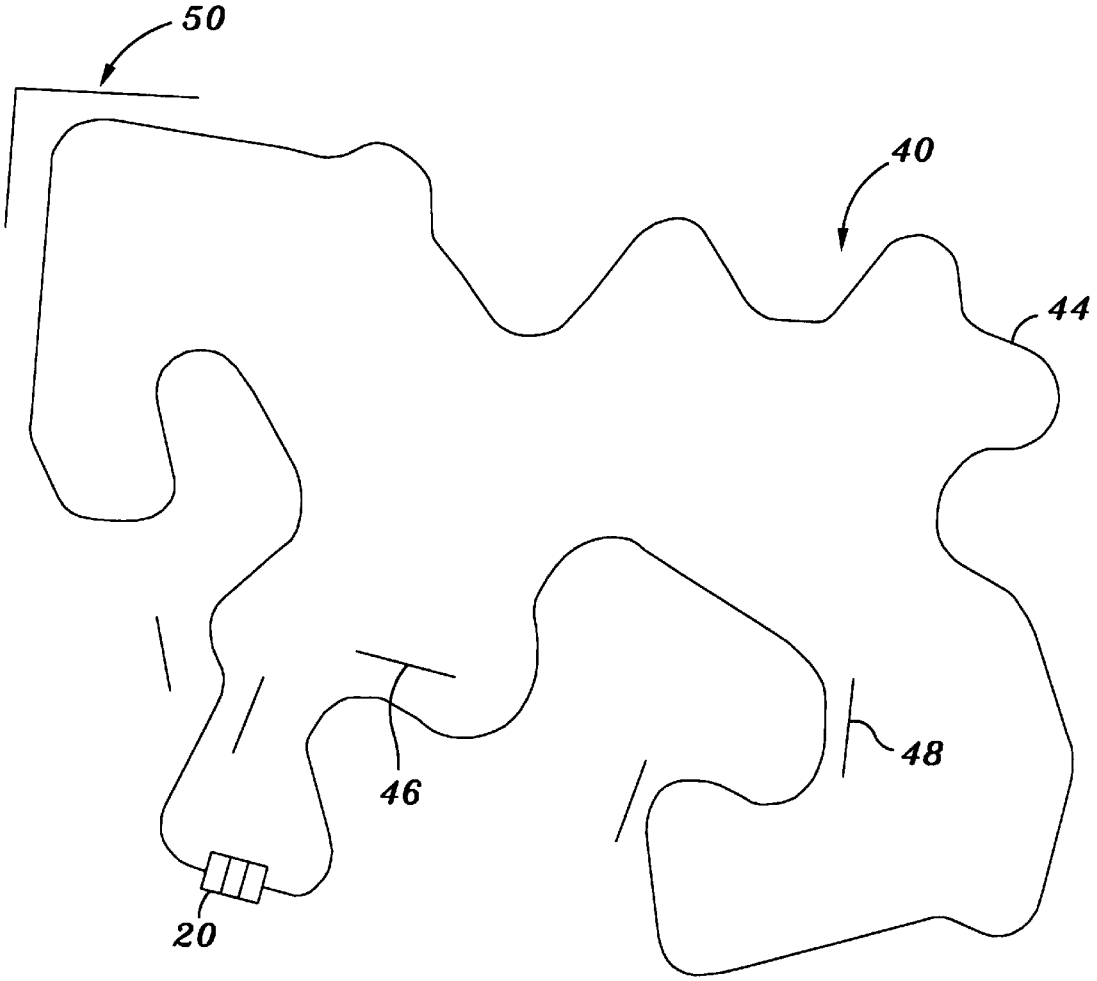
FIG. 1 is a plan view of a track for the present ride vehicle.

Referring now to the drawings, as shown in FIG. 1, an amusement ride vehicle 20 moves along a track 40 during the course of the ride. Passengers enter and exit the amusement ride vehicle 20, as shown in FIG. 1, at a loading and unloading area 50. The vehicle 20 straddles a raised guide rail 44 located along the entire track 40 of the ride. The vehicle follows the guide rail 44 along the track 40. Projection screens 46, as well as fixed or dynamic scenery 48, are located throughout the track 40.

Figure 2:
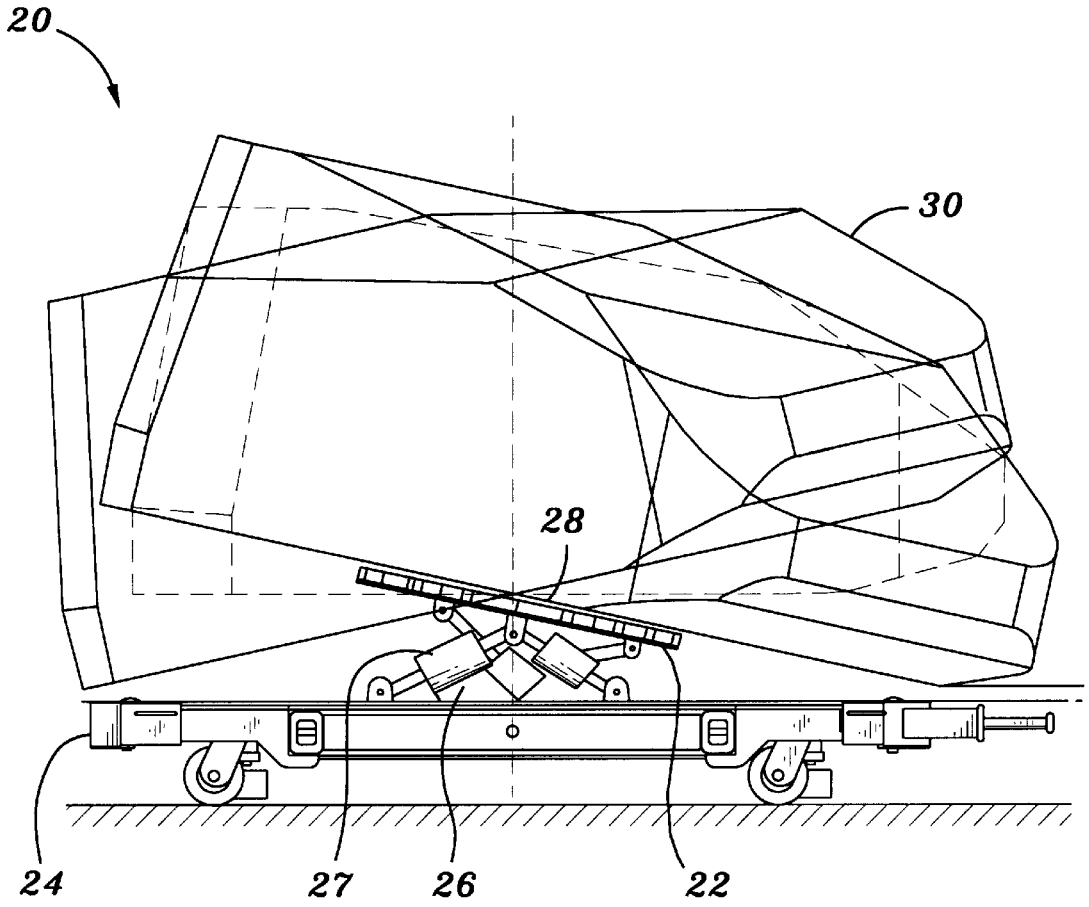
FIG. 2 is a side view of the present ride vehicle showing alternate positions.

Referring now to FIG. 2, the amusement ride vehicle 20 includes a motion base 22 supported on a chassis 24. The motion base 22 can be moved in the pitch, roll, yaw, heave, surge and slip directions. In a preferred embodiment, six screw type actuators 27 connect the vehicle chassis 24 to the motion base 22, providing the motion base 22 with six degrees of freedom. A yaw drive system 28 is attached to the motion base 22. A passenger cabin 30 is supported on the yaw drive system 28.

Referring now to FIGS. 3, 4, 5 and 6, the components that provide for movement of the passenger cabin 30, including the vehicle chassis 24, motion base 22, and yaw drive system 28, are outlined in more detail.

FIGS. 3 and 4 show a preferred embodiment of connecting the motion base 22 to the vehicle chassis 24. The vehicle chassis 24, shown in FIG. 3, provides platforms 43 to which motion base pads 66 are attached. Three motion base pads 66 are attached to three corresponding platforms 43 on the vehicle chassis 24. In this embodiment, the motion base 22 is connected to the vehicle chassis 24 by six screw type actuators 27. One end of each actuator 27 connects to the motion base 22. The other end of each actuator 27 is connected to base pads 66 which are bolted to the vehicle chassis 24. In this preferred embodiment, three base pads 66 are used with two screw type actuators 27 connected to each base pad 66. Connected to each screw type actuator 27 is an electric motor 26 that powers the screw type actuator 27.

Figure 5:
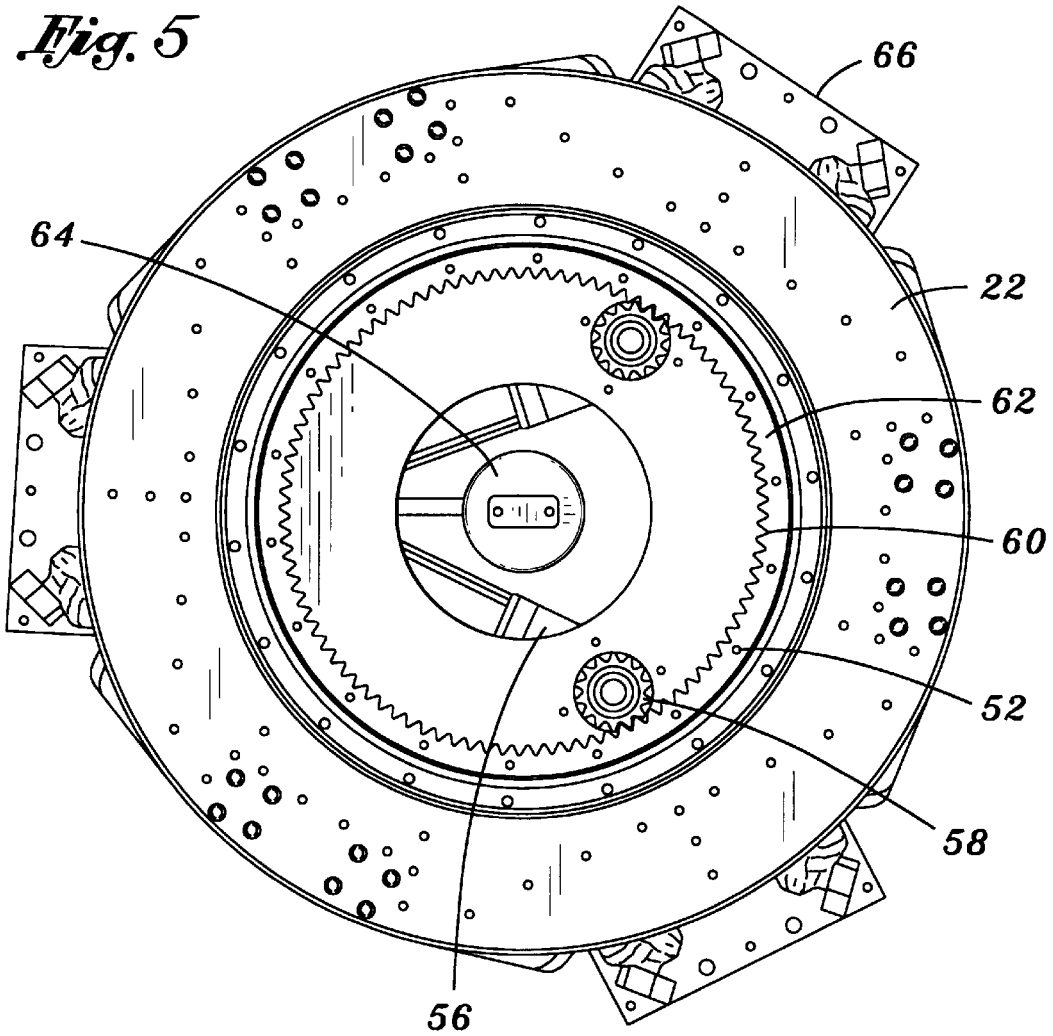
FIG. 5 is a plan view thereof.

As shown in FIGS. 2, 4 and 5, the passenger cabin 30 is attached to a ring gear 60 of the yaw drive 28 via bolt holes 52. The ring gear 60 is turned by a pinion gear 58 driven by an electric motor 56. The electric motor 56 drives the passenger cabin 30 via the gears 58 and 60 to rotate around the axis perpendicular to the surface of the motion base 22 (in yaw movement). In a preferred embodiment, two pinion gears 58 engage the ring gear 60. The yaw drive system 28 can provide clockwise or counter-clock wise rotation of the passenger cabin 30. The pinion gear 58 and the electric motor 56 are supported on, and corresponding move with, the non-rotating motion base 22.

In a preferred embodiment, the ring gear 60 is fitted into a bearing 62 (i.e. a rolling-element bearing) which connects the yaw drive system 28 and the motion base 22. The bearing 62 allows for rotation of the passenger cabin 30 without a corresponding rotation of the motion base 22 or vehicle chassis 24.

By independently controlling each screw type actuator 27, the motion base 22 and the yaw drive system 28, consequently the passenger cabin 30 is provided with six degrees of freedom and bi-directional rotation.

Advantageously, in a preferred embodiment a slip ring 64 is also provided to transmit audio, video, or other power signals to the passenger cabin 30. One end of the slip ring 64 is connected to the non-rotating motion base 22 with the other end connected to the passenger cabin 30. The slip ring 64 maintains electrical connections with the passenger cabin 30 regardless of rotation of the passenger cabin. Alternatively, circular bus bars or radio communications can be used to transmit audio, video or other signals to the passenger cabin.

Figure 6:
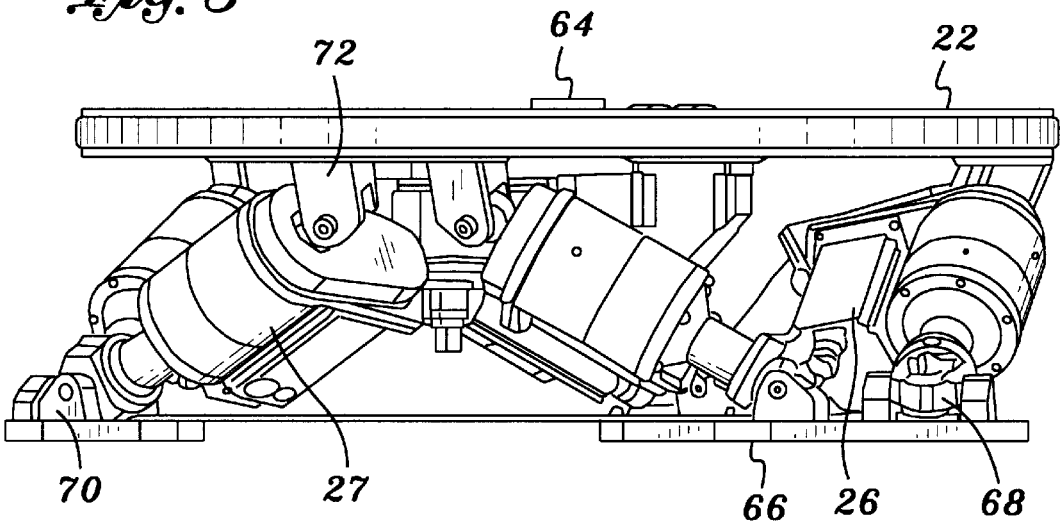
FIG. 6 is a side view thereof.

As shown in FIGS. 4 and 6, pivot joints 68 are provided to allow angular movement of the screw type actuators 27 relative to the motion base 22 and base pads 66. The flexible joints 68 can be any type of joint that allows for angular movement, but, in a preferred embodiment, universal type joints are used. The base joints 70 on the base pads 66 and platform joints 72 on the motion base 22 connect to the pivot joints 68. The joints 68 in turn are connected to the screw type actuators 27. This allows for angular movement at these connections during engagement of the screw type actuators 27.

Figure 7:
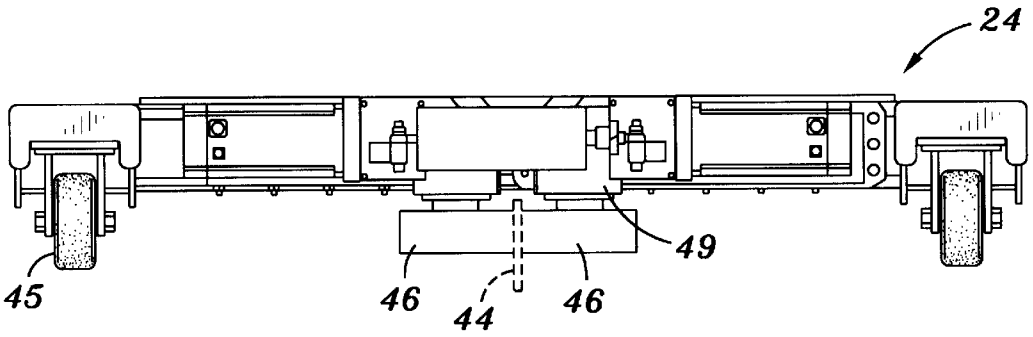
FIG. 7 is front view of the vehicle chassis shown in FIG. 3.
Figure 8:
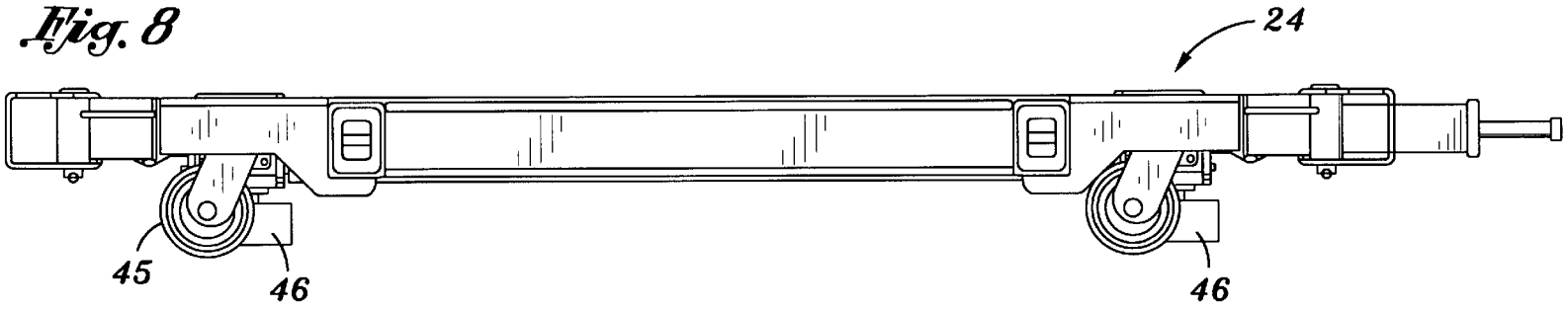
FIG. 8 is side view thereof.
Figure 9:
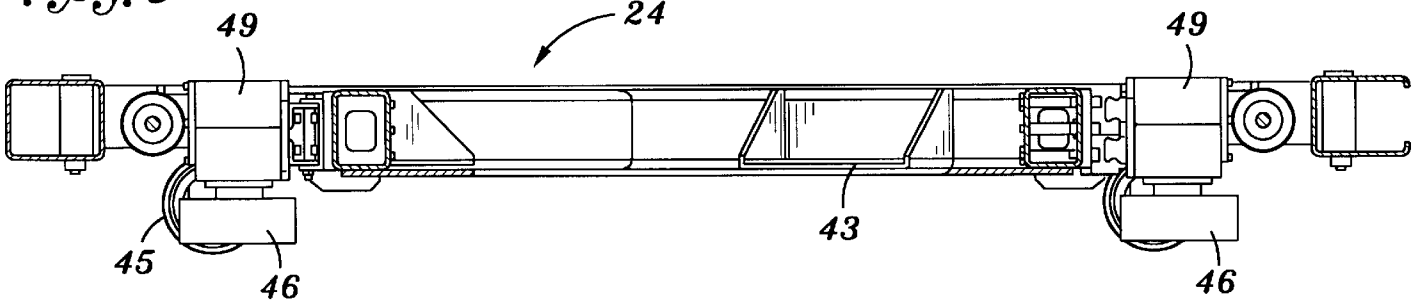
FIG. 9 is a section view thereof taken along a centerline.

Referring now to FIGS. 7, 8 and 9, the vehicle chassis 24 is moved along the track 40 on caster wheels 45. In a preferred embodiment, the wheels 45 have no drive or steering mechanism and the vehicle chassis 24 is pulled along the track 40 by front and rear pairs of opposing pinch wheels 46 pressing against the guide rail 44 and driven by on-board electric motors 49. The motors 49 are attached to vehicle chassis 24. Electric power is supplied to the motors 49 via a bus bar or similar design. Any number of vehicles 20 can be attached to the lead vehicle.

Figure 10:
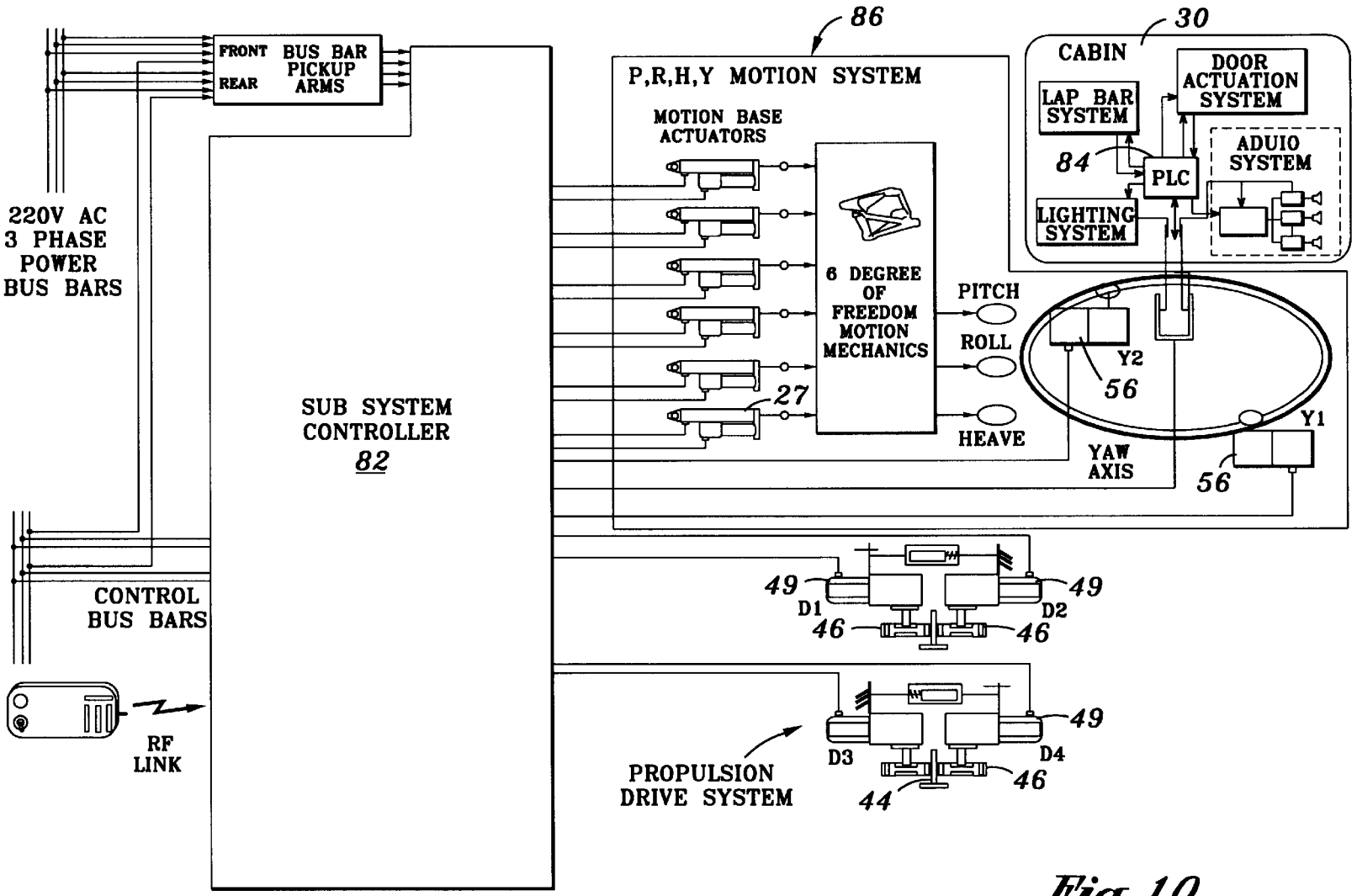
FIG. 10 is a block diagram of an amusement ride control system.

FIG. 10 shows the control system 86 for the yaw drive 28, motion base 22, vehicle chassis 24, and power routing (i.e., audio, video, lighting, lap bar mechanism 34, door etc.) to the passenger cabin 30. In operation, the control system independently regulates the screw type actuators 27, the rotation of the yaw drive system 28 and the vehicle chassis 24 movement, as well as the input to the passenger cabin 30. As the vehicle moves along the track 40, scenery 48 and visual displays on the projection screens 46 along the track 40 are triggered and controlled by a separate control system. The control system 86 includes a sub system controller 82, and a cabin PLC system 84. The sub system controller 82 controls the actuators, which move the motion base 22, the yaw drive motors 56, and the propulsion motors 49. The cabin PLC 84 controls the cabin lighting, audio, lap bar and door actuator systems.

Figure 11:
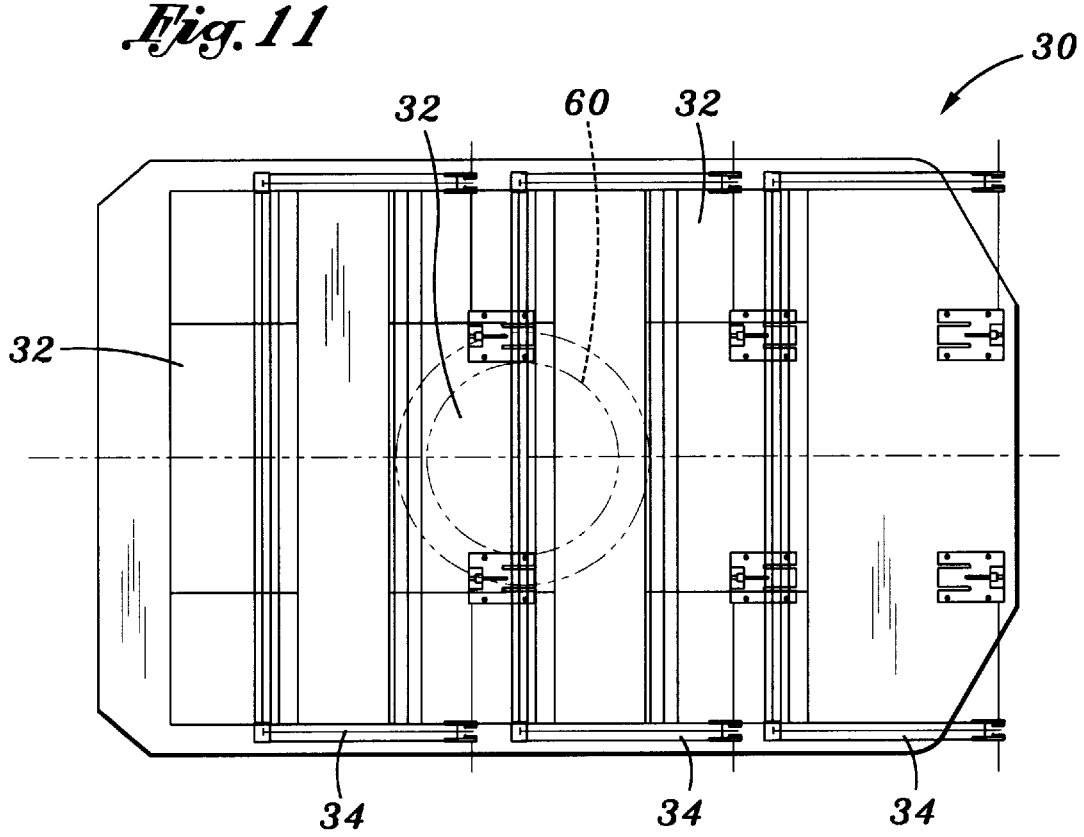
FIG. 11 is a plan view of the passenger cabin of the vehicle shown in FIG. 2.
Figure 12:
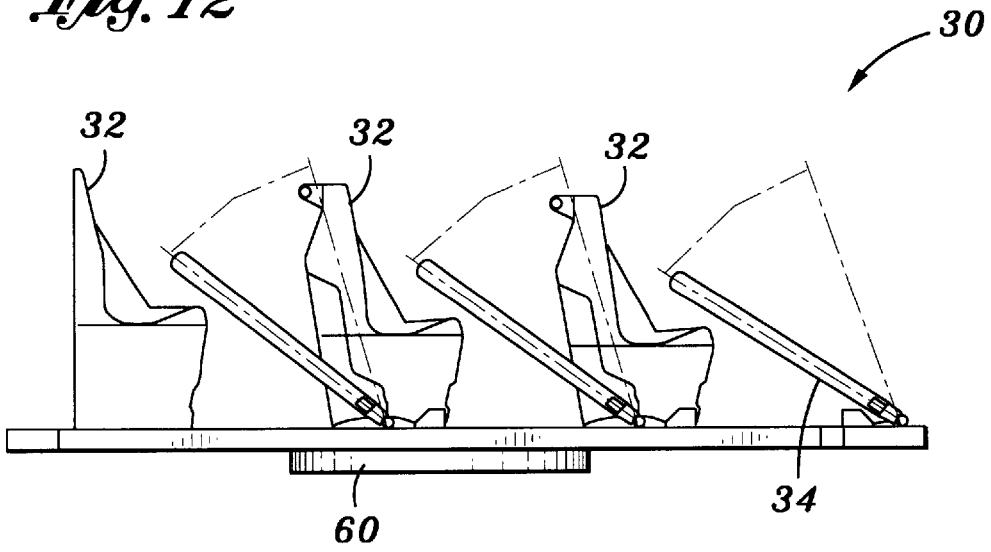
FIG. 12 is side view thereof.

As shown in FIGS. 11 and 12, the passenger cabin 30 has rows of seats 32, with each row holding multiple passengers. Laps bars 34, controlled by the cabin PLC system 84, move between open and closed positions.

In use, the vehicle 20 moves along the track 40 past projection screens 46 that provide different visual effects, for example, motion pictures, that are easily and rapidly changed. As vehicle 20 moves past these different projection screens 46, the passenger cabin 30 is moved in any number of directions and speeds to correspond to the images projected onto the screens 46. Scenery 48 (e.g. replica's of buildings, vehicles, figures, etc.) can be located throughout the path of the amusement vehicle 20. These objects are either fixed or allowed to move along a preprogrammed course. The passenger cabin 30 is moved to interact with the scenery 48.

The passenger cabin 30 is commanded via the control system to move in the pitch, roll, yaw, heave, surge, and slip directions at variable speeds, accelerations or decelerations. The vehicle chassis 24 is also commanded to stop, accelerate or decelerate (forward and backwards). The movement of the vehicle chassis 24 is also commanded via the control system to correspond to scenes provided on the projection screens 46 and/or the miscellaneous scenery 48 provided along the track 40.

As described herein, the controller, as shown in FIG. 10, commands the passenger cabin 30 to move in almost any direction or rotation and at any velocity, acceleration or deceleration, as well as control the vehicle chassis 24 to stop, accelerate or decelerate (forward and backwards).

Preferably, the passenger cabin's 30 movement, as well as the visual and audio effects provided throughout the track 40, are interconnected to give passengers a continuous adventure, with successful completion of the adventure at the end of the ride.

Additionally, by selection of different scenery 48 or different projections on screens 46 located throughout the ride, the vehicle motion base 22, yaw drive system 28 and chassis 24 can be changed to adjust the movement of the passenger cabin 30 to correspond to the new visual effects. For example, the yaw drive system can turn the cabin 30 so that the passengers are constantly facing a projecting screen head on, regardless of the movement of the vehicle along the track. As the vehicle moves to another scene, the cabin 30 can be quickly turned, using the yaw drive system, to have the passengers face another screen. The spinning movement provided by the yaw drive system also adds to the thrill of the ride experience.

While the invention is susceptible to various modifications and alternative forms, specific examples have been shown in the drawings and are described in detail. It should be understood, however, that the invention is not limited to the particular forms or methods disclosed. Rather, the invention is intended to cover all modifications and alternatives falling within the spirit and scope of the claims and their equivalents. For example, instead of pinch wheels 46 to move vehicle 20 along track 40, a conveyor system located in the floor of the track 40 could be attached to the vehicle 20. Additionally, instead of screw type actuators 27, hydraulic cylinders could be used to move the motion base 22.

We claim:

1. An amusement ride vehicle comprising:

a vehicle chassis;

a motion base connected to the vehicle chassis;

a yaw drive system, connecting the motion base to a passenger cabin, with the cabin rotatable in excess of 360° relative to the vehicle chassis, via the yaw drive system, without movement of the motion base;

and with the passenger cabin also movable in at least one other degree of freedom via the motion base.

2. The amusement ride vehicle of claim 1, further comprising means for controlling vehicle chassis movement, yaw rotation, motion base movement, and other ride control systems.

3. The amusement ride vehicle of claim 1 wherein six screw type actuators connect the motion base to the vehicle chassis.

4. The amusement ride vehicle of claim 1 wherein the vehicle chassis is propelled along a predefined track.

5. The amusement ride vehicle of claim 1 wherein projections are shown on screens located along the path of the amusement ride vehicle.

6. The amusement ride of claim 5 wherein yaw rotation and motion base movement is controlled to correspond with the projections.

7. The amusement ride vehicle of claim 1 wherein fixed or moveable scenery is located along the path of the amusement ride vehicle.

8. The amusement ride vehicle of claim 1, further including a control system, wherein movement of the passenger cabin is triggered by the control system in response to the position of the passenger cabin relative to scenery and projection screens along a path of the amusement ride vehicle.

9. The amusement ride vehicle of claim 8 wherein movement of the passenger cabin is controlled by the control system to correlate with fixed and movable scenery located along a path of the vehicle.

10. The amusement ride vehicle of claim 1 wherein the yaw drive system provides the passenger cabin with variable speed clockwise or counter-clockwise rotation.

11. The amusement ride vehicle of claim 1 wherein the yaw drive system rotates the passenger cabin in excess of 360° clockwise or counter-clockwise rotation.

12. An amusement ride vehicle comprising:

a) a passenger cabin;

b) a vehicle chassis that provides the vehicle with forward and backward motion;

c) a motion base connected to the vehicle chassis via a plurality of actuators, the motion base having multiple degrees of freedom relative to the vehicle chassis; and d) a yaw drive system, connected to the motion base and the passenger cabin, the yaw drive system providing the passenger cabin with clockwise or counter-clockwise yaw rotation, the yaw drive system including a rotatable yaw ring attached to the passenger cabin, wherein the passenger cabin is rotatable through 360° of yaw rotation without corresponding rotation of the vehicle motion base.

13. An amusement ride vehicle, comprising:

a) a vehicle chassis;

b) a motion base supported on the chassis;

c) a ring gear rotatably attached to the motion base;

d) a passenger cabin attached to the ring gear;

e) a yaw drive motor; and f) a pinion gear on the yaw drive motor, wherein the pinion gear meshes with the ring gear for turning the passenger cabin relative to the motion base.

14. The amusement ride vehicle of claim 13 wherein the motion base further comprises actuators for moving the passenger cabin in at least one of pitch, roll, heave, surge and slip movements.

15. The amusement ride vehicle of claim 13 wherein the passenger cabin can rotate 360° in clockwise or counter-clockwise direction.

16. The amusement ride attraction of claim 15 further comprising an electronic control system linked to the actuators and to the yaw drive motor, for controlling and coordinating movement of the passenger cabin.

17. An amusement ride vehicle, comprising:

a) a vehicle chassis;

b) a motion base supported on the chassis;

c) a yaw ring rotatably attached to the motion base;

d) a passenger cabin attached to the yaw ring;

e) a slip ring assembly having a first end fixed to the motion base and a second end fixed to the passenger cabin, wherein the first end if the slip ring assembly is rotatably attached to the second end; and f) a yaw drive motor linked to the yaw ring for turning the passenger cabin on the motion base.

18. The amusement ride vehicle of claim 17 wherein the yaw ring comprises a ring gear.

19. A amusement ride comprising:

a vehicle path;

a plurality of projection screens adjacent to the vehicle path;

a vehicle movable along the vehicle path, the vehicle including:

a vehicle chassis;

a motion base connected to the vehicle chassis;

a yaw drive system connecting the motion base to a passenger cabin, with the passenger cabin rotatable in excess of 360° relative to the vehicle chassis, via the yaw drive system, without movement of the motion base, and with the passenger cabin also movable in at least one other degree of freedom via the motion base.

20. The amusement ride of claim 19 further comprising means for projecting a 2-dimensional or 3-dimensional image on at least one of the plurality of projection screens.

21. The amusement ride of claim 19 further comprising fixed or movable scenery located along the vehicle path.

22. The amusement ride of claim 21 further comprising a controller linked to at least one of the motion base and yaw drive system, for moving the passenger cabin, based on the position of the vehicle relative to at least one of the scenery and projection screens.

* * * * *